US005600207A

United States Patent [19]

Worthington et al.

[11] Patent Number: 5,600,207

[45] Date of Patent: Feb. 4, 1997

[54] PREFERENTIALLY COOLED FORWARD WAVE CROSSED-FIELD AMPLIFIER ANODE

[75] Inventors: Michael S. Worthington, Hughesville; Kenneth F. Ramacher, Montoursville; Chris L. Wheeland, Winfield; Scott A. Kleinle, South Williamsport; Edward M. Doyle, Montoursville; Joseph C. Musheno, Williamsport, all of Pa.

[73] Assignee: Litton Systems, Inc., Woodland Hills, Calif.

[21] Appl. No.: 281,468

[22] Filed: Jul. 27, 1994

Related U.S. Application Data

[63] Continuation-in-part of Ser. No. 890,663, May 28, 1992, Pat. No. 5,418,427.

[51] Int. Cl.[6] ..... H01J 23/24; H01J 25/36

[52] U.S. Cl. ..... 315/39.3; 315/39.51; 313/32; 313/35

[58] Field of Search ..... 315/39.3, 39.51; 313/22, 32, 35, 36, 24

[56] References Cited

U.S. PATENT DOCUMENTS

| | | | |
|---|---|---|---|
| 2,440,851 | 5/1948 | Donal, Jr. et al. | 313/32 |
| 2,523,049 | 9/1950 | Nelson | 315/39.53 |
| 2,612,623 | 9/1952 | Spencer | 315/39.75 |
| 3,250,945 | 5/1966 | Sample | 315/3.5 |
| 3,320,471 | 5/1967 | Mims | 315/39.3 |
| 3,666,983 | 5/1972 | Krah et al. | 315/3.5 |
| 3,845,341 | 10/1974 | Addoms et al. | 313/32 |
| 4,700,109 | 10/1987 | MacPhail | 315/39.3 |
| 4,831,335 | 5/1989 | Wheeland et al. | 330/47 |
| 4,949,047 | 8/1990 | Hayward et al. | 315/505 |
| 4,975,656 | 12/1990 | Schaeffer et al. | 330/42 |

OTHER PUBLICATIONS

Technical Letter (untitled), prepared by Litton Electron Devices Division and provided to the U.S. Navy in Oct. 1992.

*Primary Examiner*—Andrew M. Dolinar
*Attorney, Agent, or Firm*—Graham & James LLP

[57] ABSTRACT

The present invention provides a double helix coupled vane forward wave crossed-field amplifier utilizing backwall cooling and vane channel cooling in the RF slow wave circuit. Backwall channel cooling is provided for the majority of the anode vanes. Additional cooling is provided exclusively for the output vanes via individual coolant carrying passages in each output vane. The coolant carrying passages are machined into each standard double helix coupled output vane to create a vane channel in the shape of a "U". A tube formed in a corresponding U-shape is inserted and brazed to the machined vane. The vane assembly is then attached to the anode body of which the backwall has holes formed to accept the tubes from each vane. Divided backwall coolant channels are brazed to the outside of the anode, thereby placing in fluid communication the coolant channels to the tubes. Accordingly, coolant is cycled from a first backwall channel, through the output vanes and through the majority of the circumference of the anode via a second backwall channel, and back into the first backwall channel through a conduit and the vanes of the anode are thus preferentially cooled.

13 Claims, 4 Drawing Sheets

FIG. 4
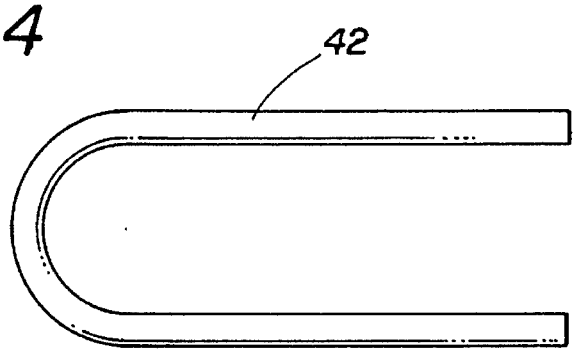
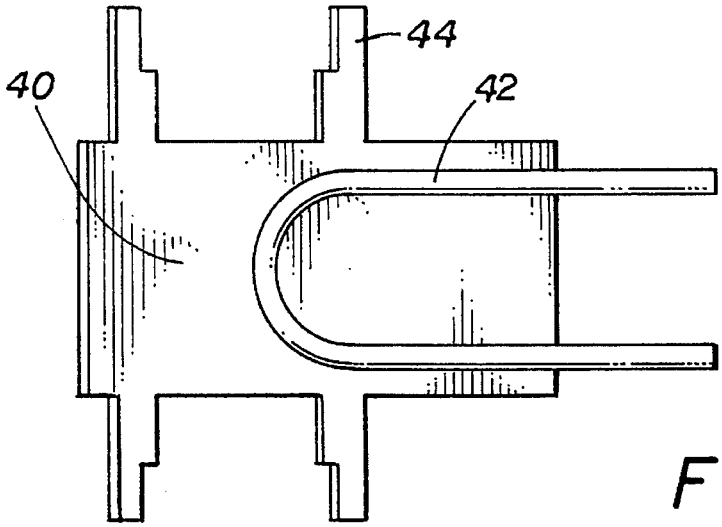
FIG. 5A
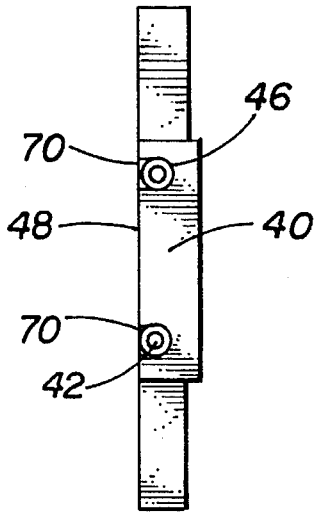
FIG. 5B

PREFERENTIALLY COOLED FORWARD WAVE CROSSED-FIELD AMPLIFIER ANODE

GOVERNMENT CONTRACT

This invention has been reduced to practice under contract with the United States Government, Contract No. N00 164-92-D-0014/0003, which may be entitled to certain rights in the invention.

RELATED APPLICATION

This is a continuation-in-part of application Ser. No. 07/890,663, filed May 28, 1992, now U.S. Pat. No. 5,418, 427, for INTERNALLY COOLED FORWARD WAVE CROSSED-FIELD AMPLIFIER ANODE VANE.

BACKGROUND OF THE INVENTION

1. Field of the Invention

The present invention relates to crossed-field amplifiers. More precisely, the present invention relates to a preferentially cooled crossed-field amplifier using a combination of backwall cooling and internal anode vane cooling to cool the anode vanes.

2. Description of the Related Art

Crossed-field amplifiers have been known for several years. These amplifiers are usually employed in electronic systems that require high power outputs, such as radar systems. Typically, crossed-field amplifiers have a secondary emission type cathode that operates on a principle of priming electron bombardment of the cathode emitting surface causing secondary electrons to be emitted. The secondary electrons then give up energy to an RF signal traveling on an anode vane structure that surrounds the cathode, thus increasing the power of the RF signal.

A problem with such high power amplifiers is the efficient removal of heat from the anode structure. When electrons leave the cathode of the crossed-field amplifier in a direction perpendicular to the magnetic field, the field causes a force to act at right angles to the electron motion. The electrons then spiral into orbit around the cathode instead of moving colinearly with the electric field. Most of the electrons gradually move toward the anode, giving up potential energy to the RF field as they interact with the anode slow-wave structure. But to impart this action, there must be high-electron discharge that generates heat build-up. The heat build-up increases as the RF wave propagates towards the RF output. As a result, the output vanes, e.g., those vanes nearest the RF output, typically must dissipate 2 to 3 times the power dissipated by an average vane.

To cool the anode, in conventional crossed-field amplifiers, coolant fluid is pumped directly adjacent to the cathode. An example of a crossed-field amplifier that is liquid cooled is disclosed in U.S. Pat. No. 4,700,109, issued Oct. 13, 1987, to G.R. MacPhail.

In double helix coupled vane crossed-field amplifiers, known in the art, oil or water coolant is supplied to the base of the anode vanes via one or more backwall channels. This standard backwall cooled anode design is sometimes inadequate to meet system requirements. In some cases, the anode vanes becomes too hot and the protective coating on the vane tips burns off.

The above-referenced copending application proposed solving this problem by incorporating a U-shaped tube into each individual vane. This circulated the coolant closer to the vane tips, helping to reduce vane tip temperature. In certain high power applications, however, this type of vane cooling required a high pressure cooling system in order to force coolant through the small diameter tube disposed in each vane. Pressure was approximately 100 psig, well above the 35 psig required in normal application. Thus, in order to better the maximum duty capabilities in such high power applications, it is necessary to further improve vane cooling and reduce cooling system pressure.

Accordingly, a need presently exists for a lower pressure cooling system which improves cooling of the output vanes of a standard double helix coupled vane crossed-field amplifier.

SUMMARY OF THE INVENTION

In accordance with the teachings of the present invention, a preferential cooling system for a distributed emission, re-entrant double helix coupled vane forward wave crossed-field amplifier is provided. In such a crossed-field amplifier, an electron emitting cathode is disposed within an anode structure. The anode structure comprises individual vanes having a fin-shape, wherein the vanes are arranged radially around the cathode.

To cool the anode, which heats up during operation due to electron impacts, the present invention provides extra cooling at those vanes nearest the RF output of the crossed-field amplifier. Additional cooling is provided for these output vanes via individual coolant carrying passages in each output vane. The coolant carrying passages are machined into each output vane to create a vane channel in the shape of a "U". A tube formed in the identical U-shape is placed in the output vane channel and brazed into the output vane. The finished output vane is then inserted into an anode body, which body includes a backwall channel that has been modified to accept the open ends of each tube. As is known in the art, conventional forward wave crossed-field amplifiers feature a divided backwall with coolant channels comprising a first backwall channel and a second backwall channel brazed to the outside of the anode. The remainder of the vanes are cooled solely by backwall channel cooling.

In order to optimally cool the vanes of a forward wave crossed-field amplifier, coolant under pressure enters a first backwall channel and flows along the first backwall channel and into a group of parallel U-shape tubes in the output vane channels. The coolant exits the U-shape tubes into a second backwall channel. The flow reverses direction and travels along the second backwall channel towards the vanes closest to the RF input. At the conclusion of the second backwall channel the coolant flows through a conduit and back into the first backwall channel, reverses direction again and flows towards the first backwall channel exit.

Empirical tests show that a crossed-field amplifier constructed according to the present invention is capable of 125 kilowatts peak at 3.3 percent duty cycle. This is twice the average power capability of conventional double helix coupled vane forward wave crossed-field amplifiers. The water pressure required to maintain this capacity is approximately 31 psig, much less than the pressure required by systems in which all vanes are internally vane cooled.

BRIEF DESCRIPTION OF THE DRAWINGS

The objects, features and advantages of the present invention will be apparent to one skilled in the art from reading the following detailed description in which:

FIG. 4 illustrates an output vane of the present invention.

FIG. 5A is a plan view that illustrates an output vane assembly wherein the tube is inserted into a channel provided in the output vane.

FIG. 5B is an end view of the vane assembly shown in FIG. 5A.

DETAILED DESCRIPTION OF THE INVENTION

Figure 1:
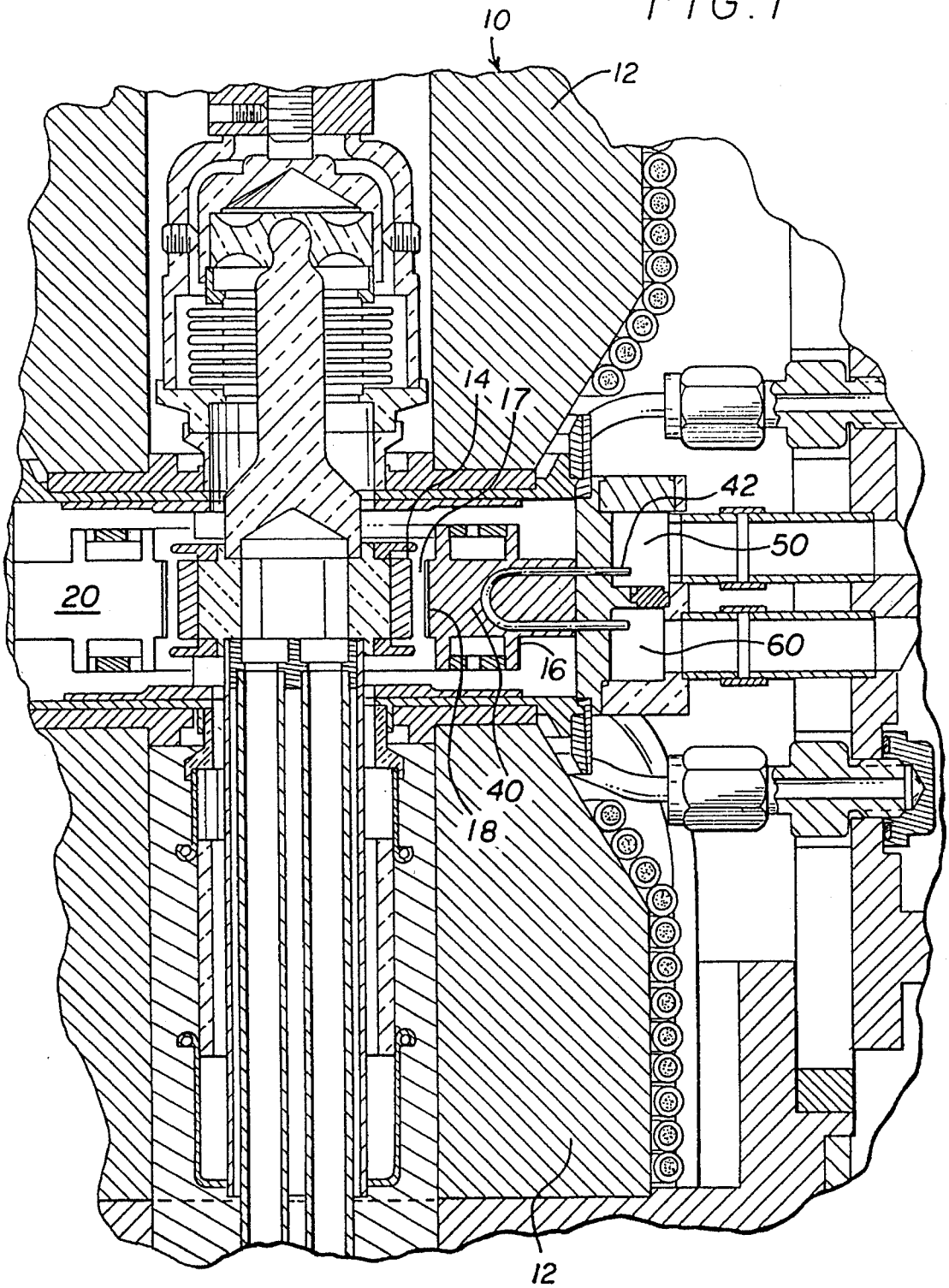
FIG. 1 is a cross-sectional view of a double helix coupled vane forward wave crossed-field amplifier incorporating a preferred embodiment of the present invention.

The following specification describes a double helix coupled vane forward wave crossed-field amplifier using backwall channel cooling and output vane cooling, in series, wherein U-shape tubes are incorporated into the output vanes. In the description, specific materials and configurations are set forth in order to provide a more complete understanding of the present invention. But it should be understood by those skilled in the art that the present invention can be practiced without those specific details. In some instances, well-known elements are not described precisely so as not to obscure the invention. In the detailed description that follows, reference numerals are used to identify individual elements of the invention. It should be understood that like numerals are used to describe like elements of the various figures.

FIG. 1 provides a partial cross-sectional view of a conventional double helix coupled vane forward wave crossed-field amplifier 10 designed to operate in the forward wave mode. The crossed-field amplifier 10 has an annular shaped anode generally denoted by reference number 16, which surrounds a cathode generally denoted by reference number 14. Further, the cathode 14 is positioned substantially at the center of the annular shaped anode 16. Above and below the anode 16 and cathode 14 are permanent magnets 12 that supply a magnetic field.

Regarding the beryllium oxide cathode emitter, calculations based on geometry and operating points of the tube indicate that a secondary emission ratio of about 2.3 is required. Beryllium oxide is the only secondary emitting material with proven long life capability at this high secondary emission ratio. With the beryllium oxide emitter, an oxygen source within the vacuum envelope is necessary to maintain a surface coating of oxide which otherwise would become depleted due to electron and ion bombardment. Moreover, a 0.2 liter ion pump may optionally be used to monitor and control the internal pressure. Two auxiliary power supplies are used in the preferred embodiment (not shown). The power supplies can be AC or DC, rated at 6 volts, 1.5 amps for the oxygen source; and a DC supply rated at 3.5 kilovolts, 300 micro amps for the ion pump. Both voltages are applied at ground potential.

Electrons emitted from the cathode 14 travel across an interaction space 17, which is co-extensive with a magnetic field established by the permanent magnets 12. Under influence from the magnetic field aligned perpendicular thereto, the electron motion is re-directed from moving directly toward anode 16 to revolving around the cathode 14. As the electrons revolve around the cathode 14, they lose velocity, and simultaneously energize an RF wave input by the RF input coupler of a wave guide assembly. The electrons amplify the RF wave as the wave propagates along the anode towards the RF output coupler.

As mentioned above, the anode 16 is preferably a double helix coupled vane design. A top view of the anode 16 is provided in FIG. 2, which shows the top helix coupled to the bottom helix. Specifically, the anode 16 comprises a slow wave structure that includes a plurality of radially extending vanes 20. Preferably, there should be sixty-two individual vanes 20. As is common in such designs, the vanes 20 are joined to a backwall 22 at a distal end 24. A drift area 30 having a size of approximately 10 pitches between the input and output couplers 32 is used for the input and output of the RF wave. In this configuration, the advantage of such a large number of vanes and a long drift region is that there is a large anode area, which correspondingly increases the average power capability of the circuit.

Figure 2:
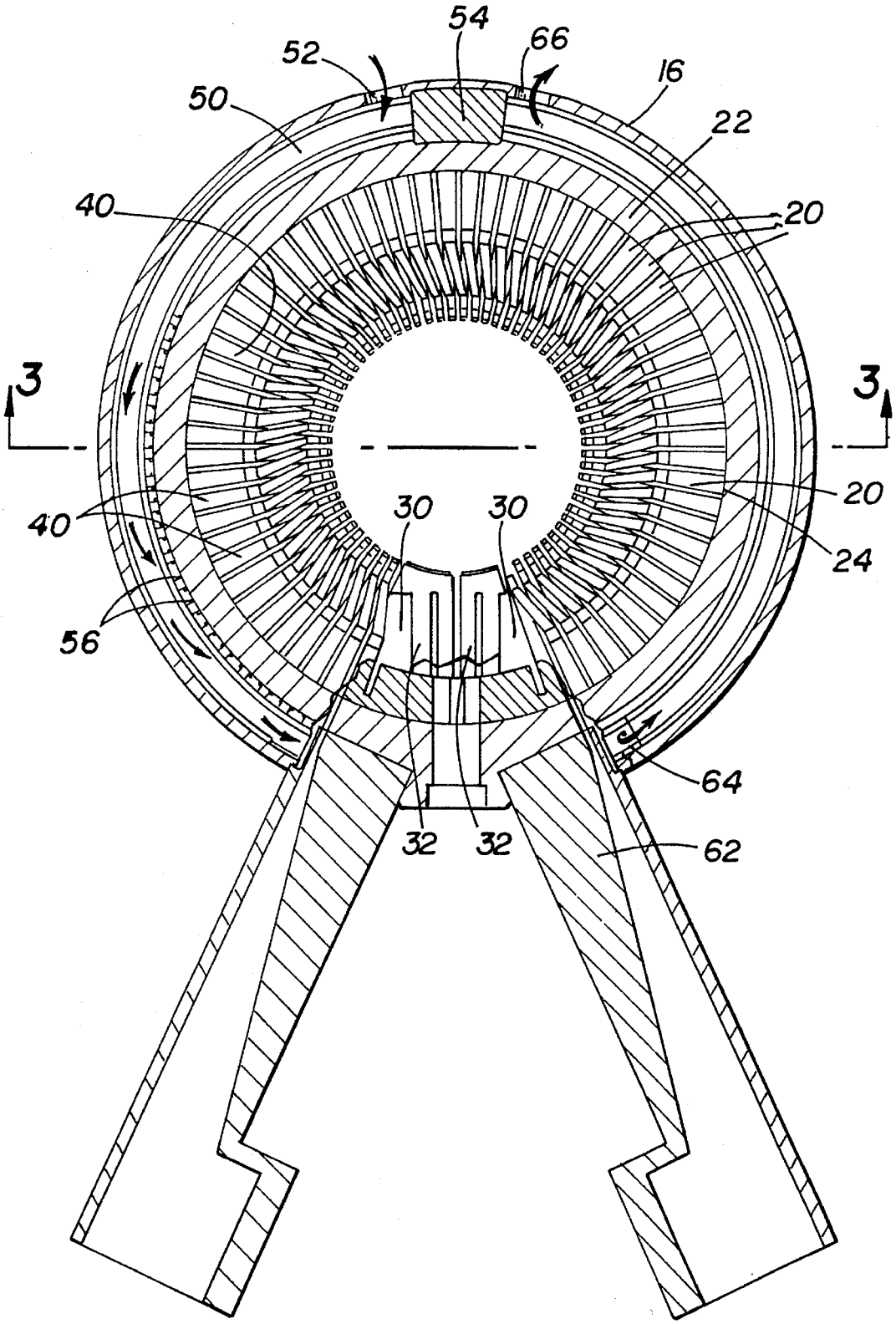
FIG. 2 is a plan view of a double helix coupled vane arrangement showing the coolant flow path.
Figure 3:
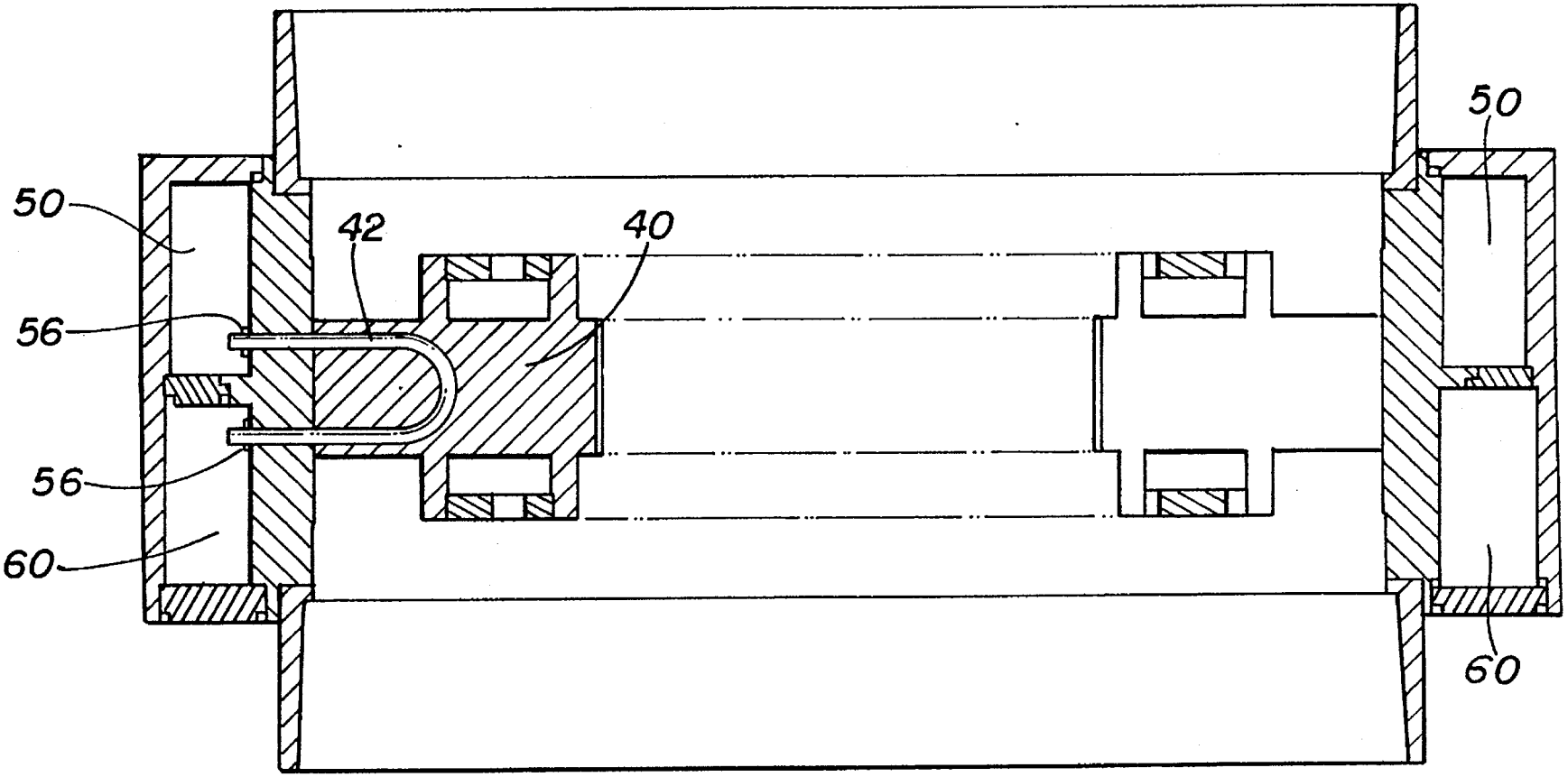
FIG. 3 is a cross-sectional view taken through the section 3—3 in FIG. 2 showing backwall coolant channels and an output vane.

Unique to the present invention is the structure for cooling the vanes 20. As seen in FIGS. 2 and 3, output vanes 40 are provided closest to the RF output. Preferably approximately one-fourth of the vanes are output vanes 40. The output vanes 40 include a U-shape tube 42. Coolant enters a first backwall channel 50 at first backwall channel entrance 52 located near an outer circumference of the anode 16. Once inside the first backwall channel 50 the coolant may only travel toward the output vanes 40 because the path in the opposite direction is sealed by backwall channel block 54. The coolant is directed into the U-shape tubes 42 in the output vanes 40. The ends of the tubes are secured to the wall of the backwall channel at 56 by known techniques such as brazing. After flowing through the output vanes in parallel via tubes 42, the coolant flows into a second backwall channel 60.

The coolant reverses direction and flows through the second backwall channel towards the RF input 62. The backwall channel block 54 does not extend into the second backwall channel 60, so the coolant may flow through a conduit 64 located proximate the RF input end of the second backwall channel 60 and return to the first backwall channel 50. Once in the first backwall channel 50 the coolant reverses direction and flows towards a first backwall channel exit 66 proximate the backwall channel block 54. Therefore, the first backwall channel 50 is in fluid communication with the second backwall channel 60 via the U-shape tubes 42 located in the output vanes 40 and the conduit 64. The coolant reservoir and a pump that drives the coolant system are well-known in the art and so are not shown.

Thermodynamic analysis and operating test data determined that conventional backwall cooled anode designs provided inadequate cooling in certain applications. Vane channel cooled anode designs required a cooling system which operated at approximately 100 psig. Neither solutions were adequate to properly control temperatures of a double helix coupled vane forward wave crossed-field amplifier within the pressures specified. In the present invention, however, by virtue of the U-shape tube 42 located in each output vane 40, a shorter conduction path is established between the circuit vane tip 18 and the liquid coolant backwall channels 50 and 60. Peak vane temperature of the output vanes may be lowered by approximately 100 degrees Celsius. The overheating problem is thus rectified by the present invention cooling system. The cooling system operates at a substantially reduced pressure because only the output vanes, approximately one quarter of the vanes, use tubes 42. Less coolant pressure is required because fewer small-diameter tubes 42 are employed. As a result a smaller, lower pressure pump may be used to drive the cooling system.

FIGS. 4, 5A and 5B illustrate construction of a preferred embodiment output vane 40 with its U-shaped tube 42. FIG. 4 shows the preferred embodiment U-shaped tube 42. The tube 42 is preferably fashioned from non-magnetic monel to have two legs joined by an arcuate intermediate portion. Of course, other shapes for the tube are possible. To be sure, the basic function of the tube 42 is to deliver coolant directly to each vane, so its shape can be varied in accordance with specific cooling and design needs.

FIGS. 5A and 5B depict an output vane assembly 40 in which the tube 42 has been attached to the output vane 40. The output vane 40 is preferably fin-shaped and has outstretched mounting posts 44 that are used during assembly of the anode 16. Prior to joining the tube 42 to the output vane 40, a channel 46 is machined into a surface 48 of the output vane 40, which vane channel 46 coincides with the shape of the tube 42. More precisely, the depth of the vane channel 46 generally approximates the outer diameter of the tube 42. After the tube 42 is inserted into the channel 46, the tube 42 is brazed thereto, and braze filler material 70 fills in interstitial spaces.

The specific process of fabricating a vane is known in the art. Generally, each vane 20 is machined from a donut shape copper block. The vane tip 18 is coated with molybdenum, as mentioned above. Then each vane is sliced from the donut by taking cuts along a radial direction. In order to produce vanes that are more resistant to delamination, the thermal resiliency of the molybdenum copper interface at the vane tip may be improved by using an explosion clad transition joint instead of a Nicoro braze to adhere the molybdenum to the copper vane. Explosion bonding or welding uses the energy of chemical explosives to produce a metallurgical bond between dissimilar metals. The explosives first clean both surfaces and then induce electron sharing between the metals. The bond is typically stronger than the weaker of the parent metals and is completely hermetic.

Although the present invention has been described in connection with the preferred embodiment, it is evident that numerous alternatives, modifications, variations, and uses will be apparent to those skilled in the art in light of the foregoing description. The present invention is further defined by the following claims:

What is claimed is:

1. A crossed-field amplifier having an RF input and an RF output, comprising:

an anode and a cathode, said anode being disposed radially along a backwall inside the amplifier and coaxially around said cathode, said anode comprising a plurality of radially disposed vanes, a subset of said plurality of radially disposed vanes comprising output vanes located proximate the RF output of the crossed-field amplifier;

means for providing backwall cooling to said plurality of radially disposed vanes proximate said backwall; and means for providing vane cooling to only said output vanes, said vane cooling means being disposed only within said output vanes and absent from the remaining vanes, thereby providing additional cooling to only said output vanes.

2. The crossed-field amplifier according to claim 1, wherein said output vane cooling means further comprises a tube in fluid communication with said backwall cooling means.

3. The crossed-field amplifier according to claim 2, wherein said tube is substantially U-shaped having two legs joined by an arcuate portion.

4. The crossed-field amplifier according to claim 3, wherein said output vanes further comprise a distal end connected to said backwall, which distal end contains said two legs of said U-shaped tube.

5. The crossed-field amplifier according to claim 2, wherein said tube is comprised of non-magnetic metal alloy.

6. The crossed-field amplifier according to claim 1, wherein said vane has a fin shape.

7. A crossed-field amplifier having an RF input and an RF output, comprising:

an anode and a cathode, said anode being disposed radially along a backwall inside the amplifier and coaxially around said cathode, said anode comprising a plurality of radially disposed vanes, a subset of said plurality of radially disposed vanes comprising output vanes located proximate the RF output of the crossed-field amplifier;

a first backwall channel in fluid communication with a second backwall channel; and means for providing output vane cooling to only said output vanes, said output vane cooling means being disposed within said output vanes, thereby providing additional cooling to said output vanes;

wherein the coolant flows into said first backwall channel through a first backwall channel entrance and into said output vane cooling means exiting into a first end of said second backwall channel where the coolant flows towards an opposite end of said second backwall channel and flows through a conduit into said first backwall channel where it exits at a first backwall channel exit.

8. A crossed-field amplifier having a pair of magnetic polepieces providing a magnetic field which crosses an electric field established between a cathode and an anode, said anode being disposed radially along a backwall inside the amplifier and coaxially around the cathode, comprising:

means for cooling the anode, said anode further comprising a plurality of radially disposed vanes, a subset of said radially disposed vanes comprising output vanes, said cooling means comprising a first and second backwall channel and a vane cooling means disposed only within said output vanes and absent from the remaining vanes for providing additional cooling exclusively to said output vanes; and coolant source supplying said anode cooling means external to said backwall.

9. The crossed-field amplifier according to claim 8, wherein said output vane cooling means further comprises a tube disposed in said output vane and in fluid communication with said first and second backwall coolant channels.

10. The crossed-field amplifier according to claim 8, wherein said tube is substantially U-shaped having two legs joined by an arcuate portion.

11. The crossed-field amplifier according to claim 9, wherein said output vanes further comprise a distal end connected to said backwall and a vane tip, said distal end containing said two legs of said U-shaped tube.

12. The crossed-field amplifier according to claim 8, wherein said tube is comprised of non-magnetic metal alloy.

13. The crossed-field amplifier according to claim 8, wherein said vane has a fin shape with said distal end being substantially thicker than said vane tip.

* * * * *

UNITED STATES PATENT AND TRADEMARK OFFICE

CERTIFICATE OF CORRECTION

PATENT NO. : 5,600,207

DATED : Feb. 4, 1997

INVENTOR(S) : WORTHINGTON ET AL.

It is certified that error appears in the above-identified patent and that said Letters Patent is hereby corrected as shown below:

Cover Page, column 1, after "(75)", delete the sixth inventor "Joseph C. Musheno."

Signed and Sealed this

Twenty-ninth Day of April, 1997

Bruce Lehman

*Attest:*

BRUCE LEHMAN

*Attesting Officer*

*Commissioner of Patents and Trademarks*